United States Patent [19]

Tamba et al.

[11] 4,343,377

[45] Aug. 10, 1982

[54] CRANK MECHANISM LUBRICATING SYSTEM

[75] Inventors: Shinichi Tamba, Kakogawa; Hitoshi Yamamoto, Nakamura; Ryoji Uda, Kakogawa, all of Japan

[73] Assignee: Kawasaki Jukogyo Kabushiki Kaisha, Kobe, Japan

[21] Appl. No.: 119,960

[22] Filed: Feb. 8, 1980

[30] Foreign Application Priority Data

Feb. 8, 1979 [JP] Japan ..... 54/15558[U]

[51] Int. Cl.[3] ..... F01M 1/06

[52] U.S. Cl. ..... 184/6.5; 123/196 R

[58] Field of Search ..... 184/6.5; 123/196 R

[56] References Cited

U.S. PATENT DOCUMENTS

| | | | |
|---|---|---|---|
| 992,458 | 5/1911 | Trott | 184/6.5 |
| 1,055,558 | 3/1913 | Renault | 184/6.5 |
| 3,096,850 | 7/1963 | Rosenquist | 184/6.5 |
| 3,703,178 | 11/1972 | Schreiber et al. | 123/196 R X |

FOREIGN PATENT DOCUMENTS

| | | | |
|---|---|---|---|
| 1041291 | 10/1958 | Fed. Rep. of Germany | 184/6.5 |
| 344089 | 3/1960 | Switzerland | 184/6.5 |

*Primary Examiner*—David H. Brown

*Attorney, Agent, or Firm*—Stevens, Davis, Miller & Mosher

[57] ABSTRACT

A crank mechanism such as in a two stroke internal combustion engine has a lubricating system comprised of an oil passage formed in the crankarm and the crankpin with one end opening to the bearing between the connecting rod and the crankpin and the other end to the side surface of the crank arm facing to the main bearing. Lubricant oil is supplied through the main bearing and an oil receiver which is located between the crankarm and the main bearing. The oil receiver is held in position by being axially compressed and resiliently deformed between the crankarm and the main bearing. For the purpose, the oil receiver is formed with a resiliently deformable portion.

6 Claims, 11 Drawing Figures

CRANK MECHANISM LUBRICATING SYSTEM

The present invention relates to crank mechanisms and more particularly to lubricating means for crank mechanisms. More specifically, the present invention pertains to means for supplying lubricant oil between crankpins and connecting rods.

In two stroke internal combustion engines wherein lubricant oil is supplied separately from fuel, it is required to maintain a supply of lubricant oil to bearings between the crankpins and the connecting rods. Conventionally, such lubricant oil supply means includes oil passages formed through crankarms and crankpins. Oil supply passages leading from oil pumps are in communication with the oil passages in the crankarms through main bearings which journal the crankshafts on the crankcases. Between the main bearings and the crankarms, there are oil receivers which function to receive lubricant oil from the main bearings and lead it to the oil passages in the crankarms. Such oil receivers are in the form of annular sheet metal members having outer peripheral guide portions for guiding the lubricant oil to the oil passages in the crankarms. The oil receivers further have central cylindrical portions adapted to be fitted to the crankshafts or cylindrical bosses extending axially from the side surfaces of the crankarms as well as annular seating portions adapted to be placed along the side surfaces of the crankarms.

In conventional arrangements, the oil receivers have been secured in position by means of screws which are threaded through the oil receivers to the crankarms. Such known arrangements have however been unsatisfactory since the manufacture and installation of the oil receivers are inconvenient. In order to eliminate the above inconveniencies, there has been proposed to provide the oil receivers with axial projections in the seating portions thereof and fit them to correspondingly formed recesses in the side surfaces of the crankarms. However, due to restrictions in manufacturing technique, the axial projections on the oil receivers cannot be make with sufficient depth so that it has been experienced that as a result of operation the fitting engagement between the projections on the oil receivers and the recesses in the crankarms is loosened. Thus, the oil receivers are therefore allowed to produce relative movements with respect to the crankarms resulting in wear in the axial projections on the oil receivers and the recesses in the crankarms. Such relative movement of the oil receivers further causes wear in the main bearing races.

It is therefore an object of the present invention to provide lubricating means for crank mechanisms including oil receivers which can be conveniently fitted in place and does not have any risk of being loosened during operation.

Another object of the present invention is to provide crank mechanism lubricating means including oil receivers which are resiliently fitted in place.

According to the present invention, the above and other objects can be accomplished by a crank mechanism comprising crankshaft means journalled on crankcase means through main bearing means and having crankarm means and crankpin means, connecting rod means connected with said crankpin means through second bearing means, lubricant oil passage means formed through said crankarm means and crankpin means and leading to said second bearing means, said crankarm means having a side surface facing said main bearing means, said lubricant oil passage means having inlet port means opening to said side surface of the crankarm means, means for supplying lubricant oil to said main bearing means at a side opposite to said crankarm means, oil receiver means provided between said main bearing means and said crankarm means for directing the lubricant oil which has passed through the main bearing mens to the inlet port means of the lubricant oil passage means, said oil receiver means including an outer peripheral guide portion, an annular seating portion adapted to be placed along said side surface of the crankarm means and central holding portion which is comprised of a cylindrical portion adapted to be fitted to a cylindrical surface of the crankshaft means between the main bearing means and the crankarm means and a resiliently deformable portion between said cylindrical portion and said seating portion, said deformable portion being adapted to be resiliently deformed by being axially compressed by the main bearing means through said cylindrical portion. In order to make the deformable portion readily deformable, various means may be adopted. For example, the deformable portion may be formed with a plurality and circumferentially spaced apertures to leave resilient bands between the apertures.

The above and other objects and features of the present invention will become apparent from the following descriptions of preferred embodiments taking reference to the accompanying drawings, in which.

Figure 1:
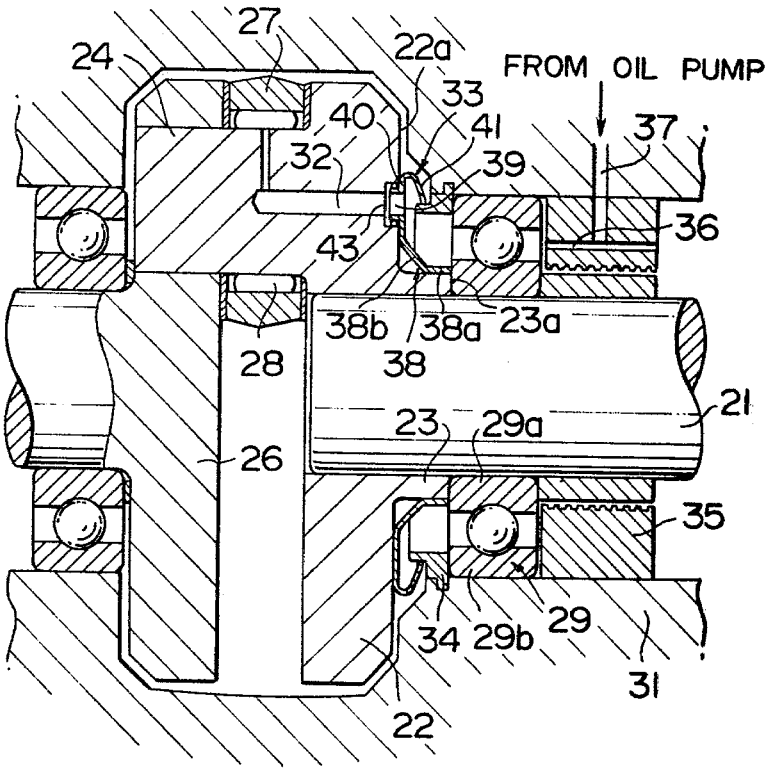
FIG. 1 is a fragmentary sectional view of a crank mechanism in accordance with one embodiment of the present invention.

Referring now to the drawings, particularly to FIG. 1, the crank mechanism shown therein includes a crankshaft 21 having one end fitted to a crankarm 22 at a boss portion 23 thereof. The crankarm 22 is formed with a crankpin 24 which is offset from the crankshaft 21 and fitted to a second crankarm 26. The crank mechanism includes a connecting rod having one end 27 journalled on the crankpin 24 through a bearing 28. The crankshaft 21 is journalled on a crankcase 31 through a main bearing 29 having an inner race **29*a* and an outer race 29*b***.

In order to provide a supply of lubricant oil to the bearing 28, there is formed an oil passage 32 through the crankarm 22 and the crankpin 24. The oil passage 32 has one end opened toward the bearing 28 and the other end to the side surface **22*a* of the crankarm 22 through an inlet port 43**.

The crankcase 31 is formed with a lubricant oil supply passage 37 which communicates with an oil passage formed in a mechanical seal member 35. The oil passage 37 receives a supply of lubricant oil from an oil pump (not shown) and the oil is passed through the passage 36 to the main bearing 29. To the side surface 22*a* of the crankarm 22, there is attached an oil receiver 33 which is made of a suitable metal plate such as a cold rolled steel sheet. Between the crankarm 22 and the main bearing 29, there is disposed an oil slinger 34 which is mounted on the crankcase 31 and has a cylindrical end extending into the oil receiver 33. The oil slinger 34 functions to direct the lubricant oil from the main bearing 29 into the oil receiver 33.

Figure 2:
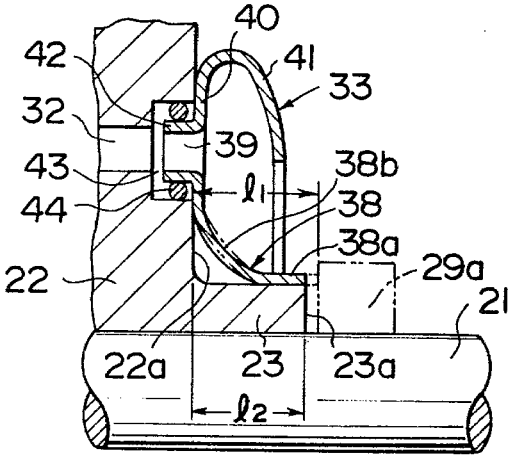
FIG. 2 is a fragmentary sectional view specifically showing the oil receiver in the structure of FIG. 1.

Referring to FIG. 2, the oil receiver 33 has a central holding portion 38 including a cylindrical portion 38*a* adapted to be fitted to the cylindrical outer surface of the boss portion 23 of the crankarm 22. The oil receiver 33 further includes an annular seating portion 40 adapted to be placed along the side surface 22*a* of the crankarm 22 and an outer peripheral guide portion 41 which encircles the oil slinger 34 and has a curved surface for leading the lubricant oil toward the inlet port 43 of the oil passage 32.

Between the cylindrical portion 38*a* of the holding portion 38 and the annular seating portion 40, the holding portion 38 further includes a resilient portion 38*b* which is tapered from the seating portion 40 toward the cylindrical portion 38*a*. In a normal state, the oil receiver 33 has an axial length $l_1$ which is larger than that $l_2$ of the cylindrical outer surface of the boss portion 23 so that the cylindrical portion 38*a* projects beyond the outer end 23*a* of the boss portion 23 as shown by dotted lines in FIG. 2.

The oil receiver 33 is formed at its seating portion 40 with an oil port 39 which is defined by an axially projecting cylindrical portion 42 formed for example by a burring process. The portion 42 is inserted into the inlet port 43 of the oil passage 32 through an O-ring 44. It will thus be noted that the lubricant oil supplied from the oil slinger 34 to the oil receiver 33 is forced under the influence of centrifugal force to flow along the guide portion 41 toward the oil port 39 to be directed into the oil passage 32.

In installing the oil receiver 33, the holding portion 38 is at first fitted to the boss portion 23 of the crankarm 22 and the projection 42 is inserted into the inlet port 43 of the oil passage 32 with the intervention of the O-ring 44. In this position, the cylindrical portion 38*a* extends beyond the end surface 23*a* of the boss portion 23. The main bearing 29 is then inserted into a position wherein the inner race abuts the end 23*a* of the boss portion 23. The cylindrical portion 38*a* is then forced in the axial direction as shown by the solid line in FIG. 2 so that the resilient portion 38*b* is radially deformed. The oil receiver 33 is therefore held resiliently between the side surface 22*a* of the crankarm 22 and the inner race 29*a* of the main bearing 29. Since the seating portion 40 of the oil receiver 33 is forced against the side surface 22*a* of the crankarm 22 under its own resiliency, the oil receiver 33 rotates as a unit with the crankarm 22 so that it is not required to provide any means such as projections in the oil receiver 33 for preventing relative movement of the oil receiver 33 with respect to the crankarm. It is therefore possible to prevent wear of the oil receiver 33.

Figure 3:
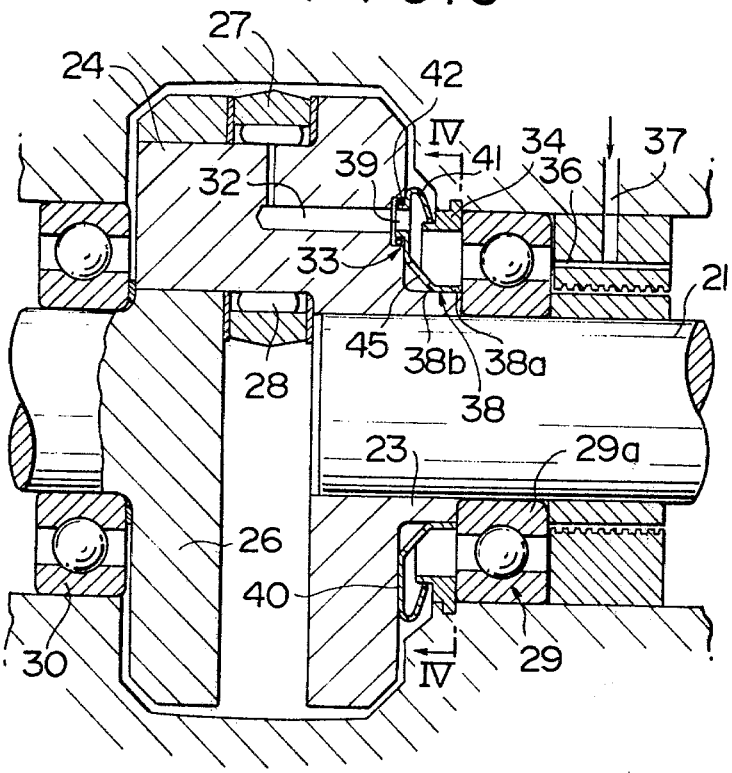
FIG. 3 is a sectional view similar to FIG. 1 but showing another embodiment of the present invention.
Figure 4:
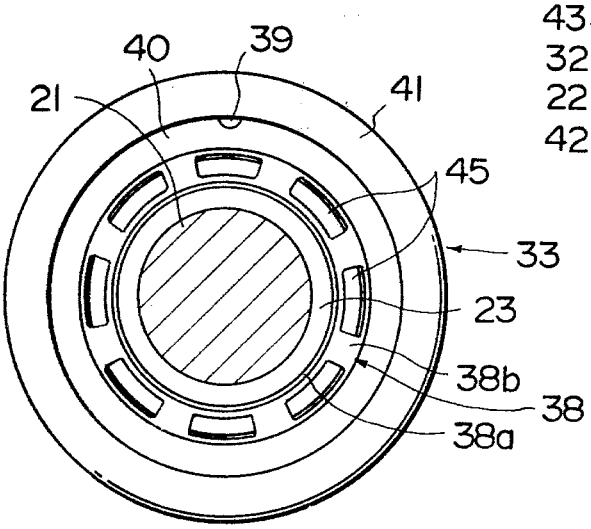
FIG. 4 is a view taken along the line IV—IV and as seen in the direction of the arrows.

Referring now to FIGS. 3 and 4, the embodiment shown therein is substantially the same as the previous embodiment so that corresponding parts are designated by the same reference numerals. In this embodiment, the deformable portion 38*b* of the oil receiver 33 is formed with a plurality of circumferentially spaced apertures 45. By properly determining the dimensions and the locations of the apertures, it is possible to obtain a desired resiliency.

Figure 5:
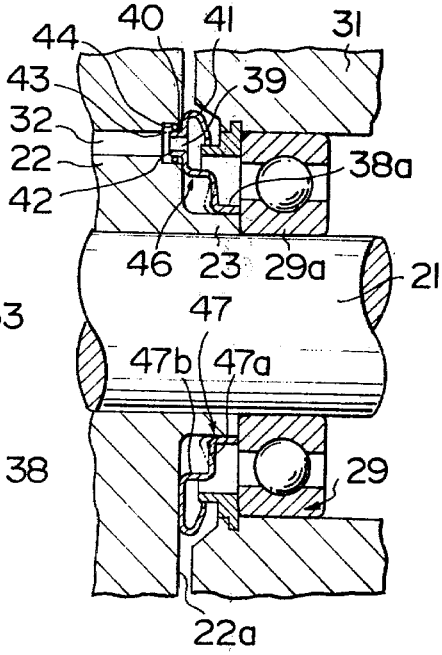
FIG. 5 is a fragmentary sectional view showing another embodiment of the present invention.

In the embodiment shown in FIG. 5, the oil receiver 46 has a deformable portion 47 which is of an angle-shaped sectional configuration having a radial portion 47*a* extending substantially perpendicularly to the cylindrical portion 38*a* and a cylindrical portion 47*b* substantially coaxial with the portion 38*a* and extending between the radial portion 47*a* and the seating portion 40. As the cylindrical portion 38*a* is axially forced by the main bearing 29, the radial portion 47*a* is resiliently deformed as shown by dotted lines in FIG. 5.

Figure 6:
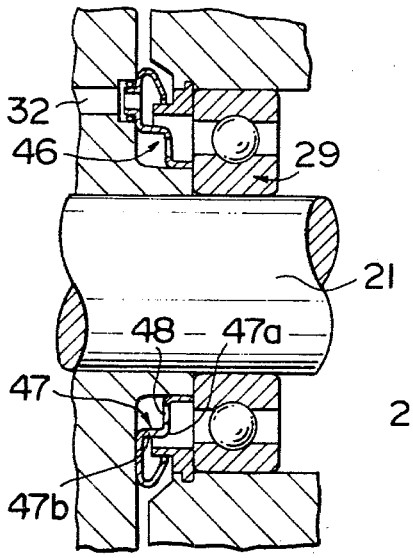
FIG. 6 is a fragmentary sectional view similar to FIG. 5 but showing a further embodiment of the present invention.

The embodiment in FIG. 6 is similar to that shown in FIG. 5 but the oil receiver 46 is formed at the radial portion 47*a* with a plurality of circumferentially spaced apertures 48 to provide the deformable portion with a desired resiliency.

Figure 8:
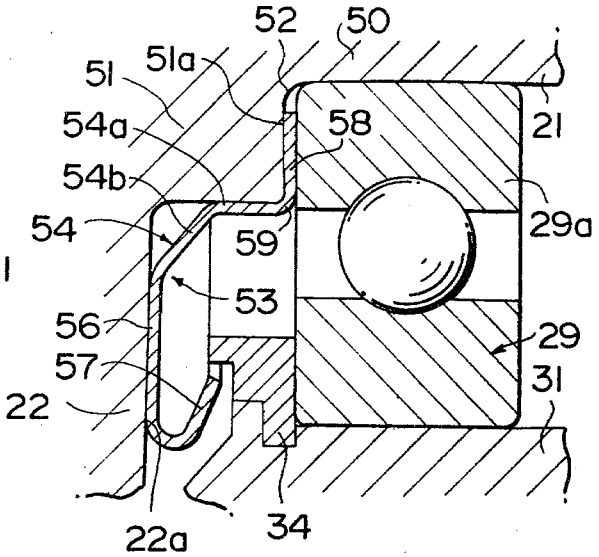
FIG. 8 is an enlarged sectional view showing the details of the structure shown in FIG. 7.
Figure 7:
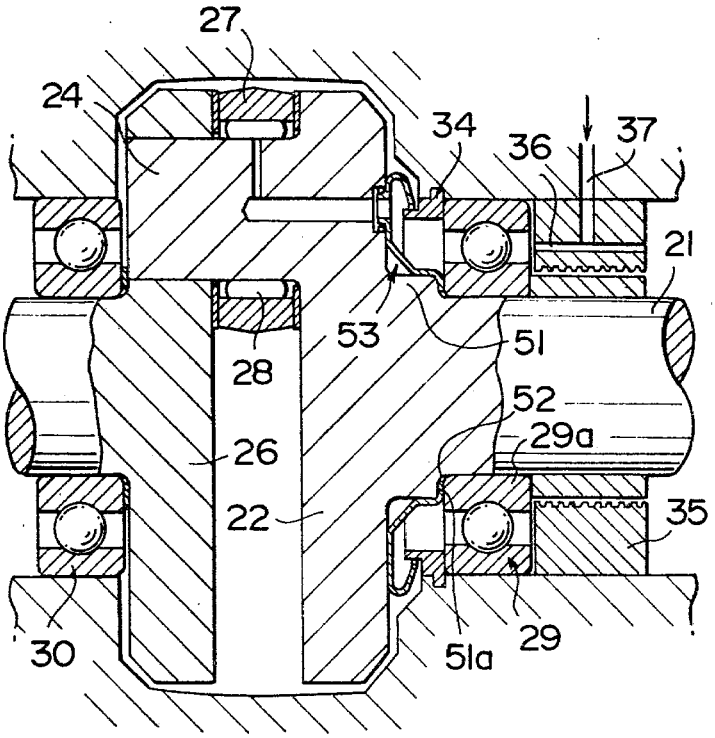
FIG. 7 is a sectional view similar to FIG. 1 but showing a further embodiment of the present invention.

Referring now to FIGS. 7 and 8, the embodiment shown therein is substantially the same as in the embodiment shown in FIGS. 1 and 2 so that corresponding parts are shown by the same reference numerals. In this embodiment, the crankshaft 21 is formed integrally with the crankarm 22. The crankshaft 21 is formed with a large diameter portion 51 adjacent to the crankarm 22. The large diameter portion 51 has an end face 51*a* which continues to the outer surface of the crankshaft 21 through a corner radius 52.

The oil receiver 53 in this embodiment includes a holding portion 54 comprised of a cylindrical portion 54*a* adapted to be fitted to the large diameter portion 51 and a resilient portion 54*b*which is of a frustoconical configuration. The oil receiver 53 further includes an annular seating portion 56 and an outer peripheral guide portion 57. At the axial end of the cylindrical portion 54*a*, there is formed a radially inwardly extending flange 58 which is adapted to be placed between the end face 51*a* and the inner race 29*a* of the main bearing 29. In the free state, the oil receiver 53 has an axial length which is larger than that of the large diameter portion 51 of the crankshaft 21 so that it is axially compressed when it is assembled in position.

The configuration of the oil receiver 53 in this embodiment is advantageous over those in the previous embodiments in that the portions 54, 56 and 58 can be simultaneously formed in a single operation by means of a press. In order to accommodate for the corner radius 59 between the portions 54*a* and 58, the large diameter portion 51 may be chamferred at its edge portion. The embodiment is considered as being advantageous in that it is possible to prevent the inner race 29*a* of the bearing 29 from riding on the corner radius 52 since the radial flange 58 functions as a spacer.

Figure 9:
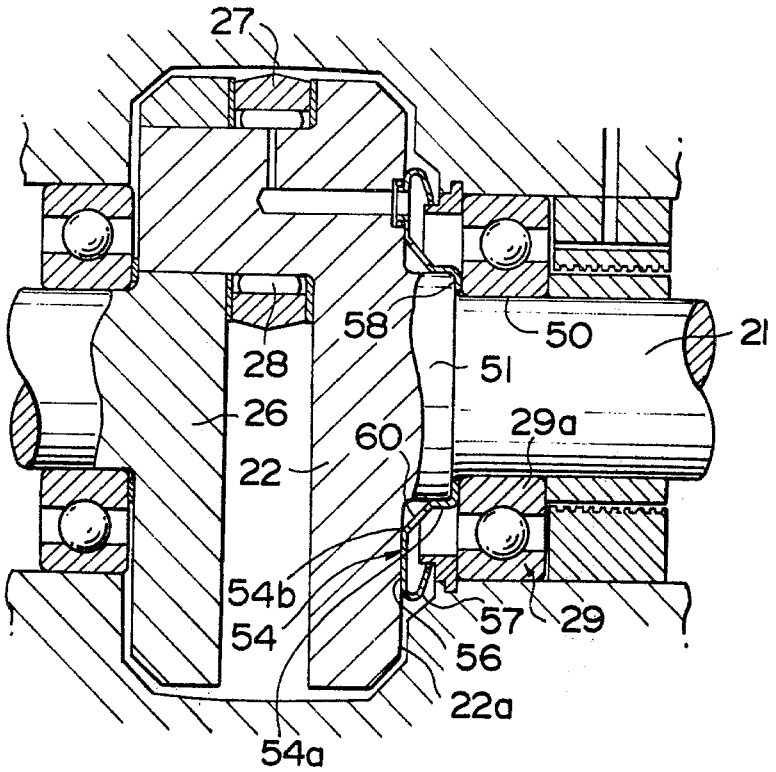
FIG. 9 is a sectional view showing another embodiment of the present invention; and, FIGS. 10 and 11 show still further embodiments of the present invention.
Figure 10:
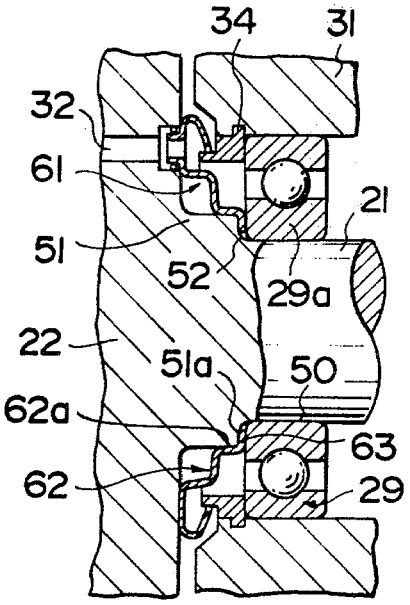
Figure 11:
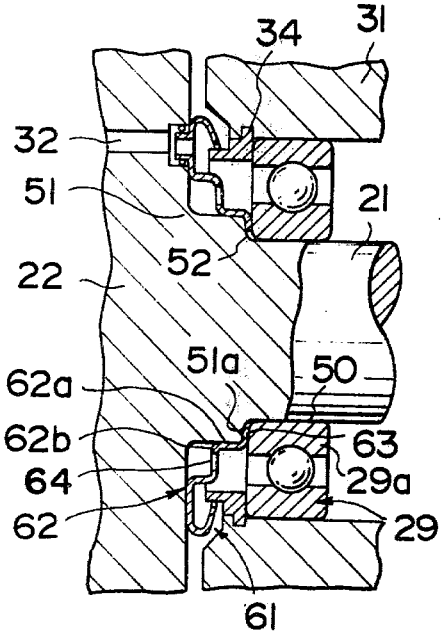

In order to obtain a desired resiliency, the oil receiver 53 may be formed at the resilient portion 54*b* with a plurality of circumferentially spaced apertures 60 as shown in FIG. 9. The embodiment shown in FIG. 10 is similar to that shown in FIG. 5. The only difference is that the oil receiver 61 has a holding portion 62 comprised of a cylindrical portion 62*a* and a resilient portion 62*b*, and a radially inwardly extending flange 63 is formed at the axial end of the cylindrical portion 62*a* so as to be held between the end face 51*a* of the large diameter portion 51 of the crankshaft 21 and the inner race 29*a* of the main bearing 29. The embodiment shown in FIG. 11 is similar to that shown in FIG. 10 except that the oil receiver 61 is formed at the resilient portion 62*b* with a plurality of circumferentially spaced apertures 64.

The invention has thus been shown and described with reference to specific embodiments, however, it should be noted that the invention is in no way limited to the details of the illustrated structures but changes and modifications may be made without departing from the scope of the appended claims.

We claim:

1. Crank mechanism comprising crankshaft means journalled on crankcase means through main bearing means and having crankarm and crankpin means, connecting rod means connected with said crankpin means through second bearing means, lubricant oil passage means formed through said crankarm means and crankpin means and leading to said second bearing means, said crankarm means having a side surface facing said main bearing means, said lubricant oil passage means having inlet port means opening to said side surface of the crankarm means, means for supplying lubricant oil to said main bearing means at a side opposite to said crankarm means, oil receiver means provided between said main bearing means and said crankarm means for directing the lubricant oil which has passed through the main bearing means to the inlet port means of the lubricant oil passage means, said oil receiver means including an outer peripheral guide portion, an annular seating portion adapted to be placed along said side surface of the crankarm means and central holding portion which is comprised of a cylindrical portion adapted to be fitted to a cylindrical surface of the crankshaft means between the main bearing means and the crankarm means and a resiliently deformable portion between said cylindrical portion and said seating portion, said deformable portion being adapted to be resiliently deformed by being axially compressed by the main bearing means through said cylindrical portion.

2. Crank mechanism in accordance with claim 1 in which said deformable portion is formed with a plurality of circumferentially spaced apertures.

3. Crank mechanism with claim 1 in which said deformable portion is of a substantially frustoconical configuration.

4. Crank mechanism in accordance with claim 1 in which said cylindrical portion has an axial end which is formed with a radially inwardly extending flange, said crankshaft means having a large diameter portion which is adjacent to said crankarm means and has an end face, said flange being held between said end face of the large diameter portion and the main bearing means.

5. Crank mechanism in accordance with claim 1 in which said resiliently deformable portion includes a substantially radially extending first portion coninuous with said cylindrical portion of the holding portion and a substantially cylindrical second portion extending between said first portion and said seating portion.

6. Crank mechanism in accordance with claim 5 in which said first portion of the deformable portion is formed with a plurality of circumferentially spaced apertures.

* * * * *